United States Patent [19]

Rines

[11] 4,014,427

[45] Mar. 29, 1977

[54] VARIABLE BOTTOM-EDGE MARGIN INDICATOR AND METHOD FOR TYPEWRITER PAPER AND THE LIKE

[76] Inventor: Carol M. Rines, 65 India Wharf, Boston, Mass. 02110

[22] Filed: July 15, 1975

[21] Appl. No.: 596,145

Related U.S. Application Data

[63] Continuation of Ser. No. 383,709, July 30, 1973, abandoned.

[52] U.S. Cl. ..... 197/189; 197/192

[51] Int. Cl.[2] ..... B41J 29/44

[58] Field of Search ..... 197/119, 140–142, 197/187, 189, 192

[56] References Cited

UNITED STATES PATENTS

| | | | |
|---|---|---|---|
| 531,893 | 1/1895 | Ashby | 197/189 |
| 815,644 | 3/1906 | Shea | 197/189 |
| 1,656,491 | 1/1928 | Maulme | 197/189 |
| 2,595,178 | 4/1952 | Stricklin | 197/189 |
| 2,675,904 | 4/1954 | Maurer | 197/189 X |
| 2,689,033 | 9/1954 | Grenier | 197/189 |
| 2,879,876 | 3/1959 | Palmer et al. | 197/52 X |
| 2,914,160 | 11/1959 | Pohl et al. | 197/189 UX |
| 3,091,321 | 5/1963 | Ashworth | 197/189 |
| 3,276,562 | 10/1966 | Mathews | 197/189 X |

FOREIGN PATENTS OR APPLICATIONS

| | | | |
|---|---|---|---|
| 1,090,636 | 10/1954 | France | 197/189 |
| 1,812,168 | 8/1970 | Germany | 197/189 |
| 646,183 | 9/1962 | Italy | 197/189 |
| 677,624 | 12/1964 | Italy | 197/189 |

*Primary Examiner*—Edgar S. Burr
*Assistant Examiner*—Paul T. Sewell
*Attorney, Agent, or Firm*—Rines and Rines

[57] ABSTRACT

This disclosure deals with variable bottom-edge margin indication for typewriter paper and the like in which the sensor-monitoring of the bottom edge of a side margin of the paper is disposed at variably calibratingly adjustable regions, preferably near a side end, of the platen, with ready external calibration control thereof and momentary bell alarm upon the reaching of the preset bottom edge margin.

1 Claim, 5 Drawing Figures

VARIABLE BOTTOM-EDGE MARGIN INDICATOR AND METHOD FOR TYPEWRITER PAPER AND THE LIKE

This is a continuation application of Ser. No. 383,709, filed July 30, 1973, now abandoned.

The present invention relates to bottom-edge margin indicating apparatus and techniques for typewriter paper and the like.

The concept of providing paper-end indicators for typewriter paper and related sheets is quite old; with the art attempting in various ways to provide a ready practical attachment for typewriters to attain such ends, particularly since the advent of electrically operated typewriters that made the use of electrical power available for signaling purposes. Illustrative of such prior attempts are later-discussed U.S. Pat. Nos. 2,595,178 and 3,091,321 and the references cited therein. Despite such proposals, however, such devices have not found their way upon the general market, and the world of typists, apart from automatic preset computer-controlled machines, has had to put up with the wasteful process of retyping where bottom margins have inadvertently been seriously neglected or overlooked during the pressure of typing, or the public has had to content itself with, and indeed has had to accept as a necessary and inherent evil, irregular bottom margins from page to page.

Among the reasons for the lack of commercial practicality of such prior proposals as those described in said Letters Patent, is their inherent inflexibility for simple operator adjustment and preset bottom margin calibration variation, as well as signal techniques foreign to the customary alarm or warning indicators to which the army of typists of all generations has become accustomed. Apparently, the direction taken in attempting to provide such indicators, including the positioning and nature of the sensors, led away from the concepts of the present invention and the novel results attendant thereupon. In accordance with the present invention, on the other hand, such difficulties or disadvantages have now been overcome by novel sensor positioning and adjustable calibrated control and alarm, thus providing a new and improved variable bottom-edge margin indicator and method for typewriter paper and the like.

A further object is to provide such a novel indicator with flexibility for practical and simple controlled variable adjustment by the operator, and, where not initially incorporated as part of the original typewriter equipment, adapted for universal and ready attachment and removal from existing machines.

Still another object is to provide a novel margin indicator of more general utility, as well; other and further objects being explained hereinafter and more particularly pointed out in the appended claims.

The invention will now be described with reference to the accompanying drawing,

FIG. 1 of which is an exploded isometric view of a preferred embodiment with the end roll of the platen cut away and the roller shield displaced below the platen to illustrate details of construction;

Figure 2:
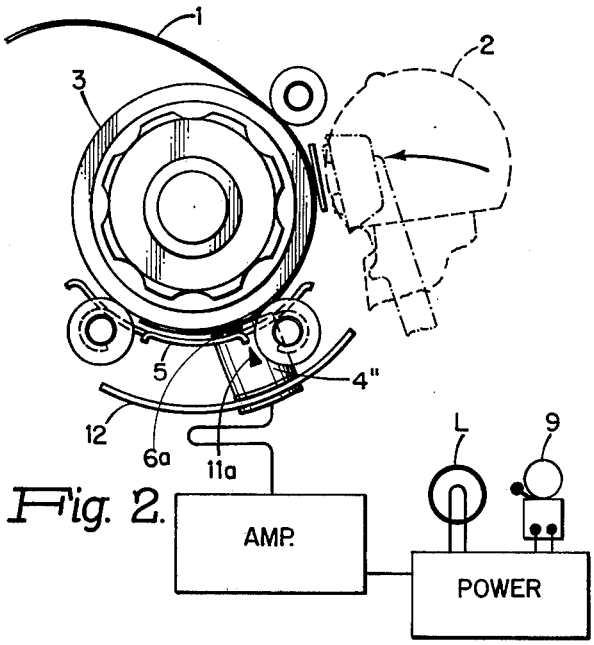
FIG. 2 is a combined side-elevation and schematic block circuit diagram of a modified embodiment.

Referring to FIG. 2, the paper or other sheet 1 is shown being typed upon, or otherwise printed or recorded upon (and hereinafter generically referred to as a typewriter paper), by, for example, an electric typewriter printing head or ball 2, the paper 1 being transversely advanced during the typewriting around the circumferential cylindrical surface of the longitudinal axially rotatable platen 3, as is well known.

Figure 5:
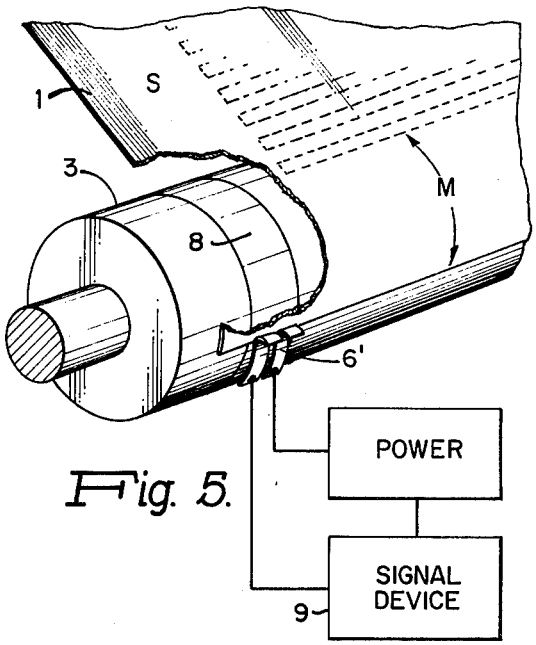

While conventional side margin setting devices have long been used, adjusting, for example, the left-hand side margin S of the paper 1 (FIG. 5), such devices are not adapted to the problem of indicating the bottom-edge margin M, and, more particularly, the variable presetting and adjustment thereof. Underlying the present invention, unlike the before-discussed prior art approaches, is the recognition that the bottom margin sensor has a rather critical preferred range of location regions for the purposes desired; specifically, in FIG. 1, a band 4, circumferentially curved to correspond to the underside of the platen 3 and the juxtaposed longitudinal coaxially mounted paper-roll shield 5, carries a pair of electrically insulated adjacent sensor electrical contacts 6, adjustable circumferentially by sliding transversely within a guide 7 carried by the underside of the roll shield 5. With the insulative paper 1 received between the region of the sensor contacts 6 and juxtaposed conductive band 8 circumferentially carried by the platen 3, preferably near its left-hand side or end, as shown, the contacts 6 are electrically isolated from one another. When, however, the bottom edge of the left-hand margin S of the paper 1 moves upward beyond and to expose the contacts 6 to the conductive band 8, the latter electrically connects the contacts 6 together, producing an electrical signal that, in accordance with a preferred feature of the invention energizes a bell or similar audible alarm or warning device 9, powered from the mains, for example, at 10, to demonstrate the reaching of the desired bottom margin M.

Figure 1:
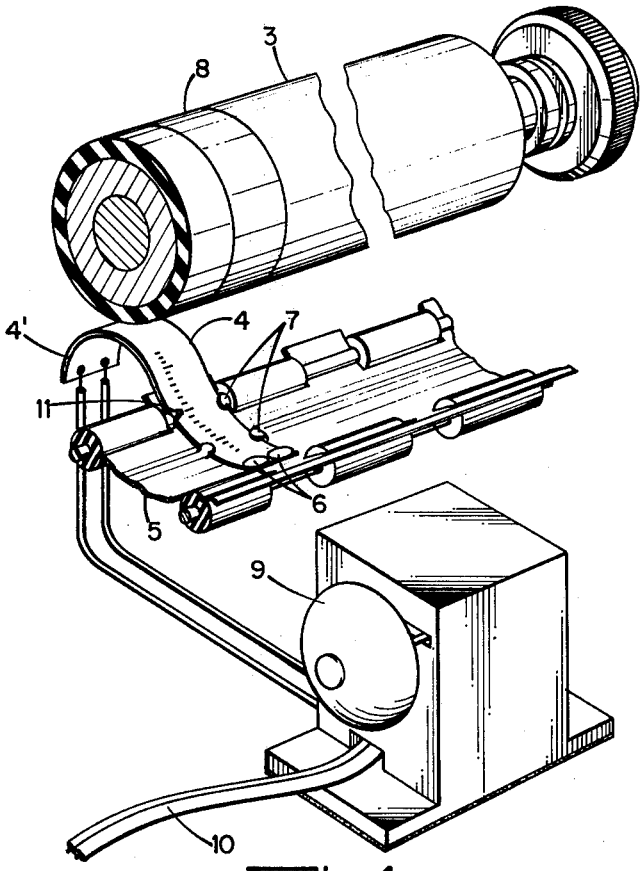

It should be noted that the conductive band 8 serves as a short-circuiting, floatable potential member in the embodiment of FIG. 1, and that the bell or similar alarm 9 is preferably only momentarily activated upon the advent of the signal produced by the short-circuiting of the contacts 6 by the band 8, latching out as is well-known, and providing the customary type of warning to which typists are accustomed, though perhaps of a different and characteristic tone than the right-hand side margin tones.

Further in accordance with the invention, the bottom margin M (FIG. 5) may be calibratingly and accurately preset or adjusted for different-dimensional bottom-edge margins, merely by externally sliding the contact band 4, from the side, within the guide 7 to the desired calibration marking at the indicator pointer 11. The bottom margin setting band 4 may be of insulative material housing the electrical connections to the contacts 6 and may be provided with the external rearward tab 4' for enabling such facile adjustment by the operator. As is evident in FIG. 2, and more particularly in the other figures, as well, it has been determined that the range of adjustment for the contacts 6 preferably lies generally forward of the bottom of the platen 3, with the calibrations readily exposed to the operator.

In the system of FIG. 2, the contacts 6*a* are shown carried by a cylindrical adjustment lever or arm 4'', circumferentially adjustable within a lower guide 12 below the roll guide 5, with the margin calibrations or positional adjustment indicated by the pointer 11*a*. Additionally, if desired, a supplemental lamp indicator L may also be employed. The sensor contacts may also be of other forms, if desired, such as the separate adjacent spring fingers 6' of FIG. 5.

Figure 3:
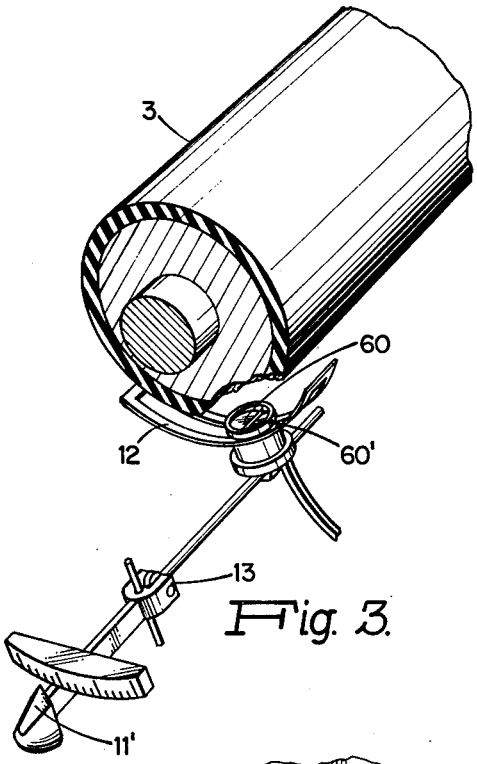
FIG. 3 is a similar view of a modified light-detecting sensor arrangement, again in exploded position.
Figure 4:
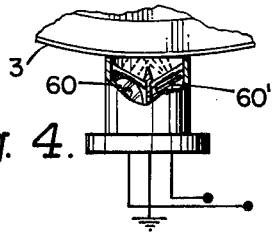
FIG. 4 is a fragmentary side elevation, with parts broken away, of the applied sensor system of FIG. 3; and, FIG. 5 is an isometric view of a system intended to have the adjustment and calibration structure of FIGS. 1 or 2, but with a pair of resilient finger electrical sensor contracts.

While the invention has been heretofore illustrated with electrical contact sensors, moreover, clearly other types of sensors, including light-sensitive devices, may also be employed as illustrated, for example, in the embodiments of FIGS. 3 and 4. The roll guide 5 has not been shown in these figures to avoid complicating the drawing; a light source 60 and reflected light detector 60' (responsive, for example, to the reflectivity difference between the paper 1 and the platen surface 3), being shown circumferentially adjustable transversely within guide 12, by the coupled link arm 13, with its bottom margin calibration indicator 11'.

Further modifications will also occur to those skilled in this art and all such are considered to fall within the spirit and scope of the invention as defined in the appended claims.

What is claimed is:

1. A variable bottom-edge margin indicator for typewriter paper and the like having, in combination with a typewriter of the type having a ball printing head, a cylindrical typewriter platen rotatable about its axis, immobile along its axis, and around the cylindrical surface of which the paper is advanced in a transverse path during typewriting, and a cylindrical-section paper shield beneath the platen; sensor means mounted beneath the platen inwardly of and adjacent to one end of the platen in the region of the paper shield and the path of advancement of the adjacent-side margin of the paper and disposed to receive said side margin of the paper between the sensor means and the platen at said region, said sensor means having means for discriminating between the presence and absence of said paper at said region and producing an electrical signal indicative of the advent of said absence corresponding to the advancement of the bottom edge of the side margin of the paper out of said region, said discriminating means comprising a pair of insulated electrical contacts closely separated at substantially the same circumferential region of said platen and cooperative with juxtaposed conductive band means circumferentially carried by the platen; indicator means connected to said sensor means and responsive to said signal and comprising audible signal means; means for adjusting the position of said sensor means transversely circumferentially about the platen correspondingly to vary the location of said region, said adjusting means comprising insulating band means carrying said contacts at its forward end, housing therein conductors for connecting said contacts to a power source, and adjustably disposed transversely within guide means provided under and adjacent said platen and upon said paper shield, said band means extending rearwardly of said paper shield to provide exposed tab means for enabling the circumferential adjustment of the band means within said guide means and along said paper shield and to provide an exposed region at which said conductors housed in said band means are connected to further conductors leading to said power source, and calibration setting means cooperative with said adjusting means and disposed external to said platen and sensor means to enable viewing of said calibration setting means by the operator for controlling the tab means of said adjusting means in order to vary the region, correspondingly to set different-dimensional desired bottom-edge margins of the paper.

* * * * *